United States Patent [19]

Winter

[11] Patent Number: 4,625,266

[45] Date of Patent: Nov. 25, 1986

[54] LIGHTABLE NOSING BAR ASSEMBLY FOR STAIRWAYS

[76] Inventor: Rolf Winter, Kaspar-Kerll-Str. 2, 8000 München 60, Fed. Rep. of Germany

[21] Appl. No.: 699,902

[22] Filed: Feb. 8, 1985

[30] Foreign Application Priority Data

Feb. 10, 1984 [DE] Fed. Rep. of Germany ..... 3404813

[51] Int. Cl.[4] ..... F21S 1/02; F21S 1/14; E04F 11/00

[52] U.S. Cl. ..... 362/146; 362/32; 362/362; 362/145; 52/188

[58] Field of Search ..... 362/146, 145, 32, 362; 52/188, 179

[56] References Cited

U.S. PATENT DOCUMENTS 4,143,411 3/1979 Roberts ..... 362/362
4,394,714 7/1983 Rote ..... 362/32

FOREIGN PATENT DOCUMENTS 2437580 11/1975 Fed. Rep. of Germany ..... 362/32
2115451 9/1983 United Kingdom ..... 52/188

*Primary Examiner*—E. Rollins Cross
*Attorney, Agent, or Firm*—Fishman & Dionne

[57] ABSTRACT

A nose edge of a step of a stairway is to be marked by a lighted strip which can be seen by a person going upstairs and by a person going downstairs. This is to be accomplished by a nosing bar assembly which comprises a single illuminating device and in which transparent covering means for such illuminating device are not liable to be strongly damaged or soiled. For this purpose covering for the illuminating device is so arranged below the level of the tread surface of the step that points of the surface of the covering means can be seen from a space which is disposed above the tread surface of the step and which in the downstairs direction is defined by a vertical plane which contains the front boundary line of the tread surface.

6 Claims, 4 Drawing Figures

LIGHTABLE NOSING BAR ASSEMBLY FOR STAIRWAYS

BACKGROUND OF THE INVENTION

This invention relates to a lightable nosing bar assembly comprising a profiled metal rail, which is adapted to be secured to a nose edge of a step of a stairway and is provided in a portion of its cross-section that is disposed below the level of the tread with a longitudinally extending recess, which at least in a section of its length is exposed toward the free environment in a direction having a horizontal component, also comprising transparent covering means for covering the exposed portions of the longitudinally extending recess, and an illuminating device, which is disposed in the recess behind the covering means and extends throughout the length of the nose edge.

DISCUSSION OF PRIOR ART

In a known nosing bar assembly of that kind the profiled metal rail is angle-shaped in cross-section and in its flange which is vertical in position of use has a groove, which is approximately square in cross-section and contains a slidably iserted tubular bar, which consits of transparent plastic material and contains in its cavity a set of miniature lamps connected to longitudinally extending lead wires. Said miniature lamps are energizable, e.g., by a voltage of 12 or 24 volts and when energized will ensure that the nose edges of a stairway are marked by illuminated stripes. The transparent tubular bar is held in the groove formed in the profiled metal rail by small profiled projections provided on the two parallel faces of the groove.

In the known nosing bar assembly the exposed surface of the transparent tubular bar extends in a vertical plane, which constitutes the front boundary of the vertical flange of the profiled metal rail, so that the illuminating device provided in the known nosing bar assembly and the light emitted by said illuminating device can be seen only by a person who is going downstairs.

SUMMARY OF THE INVENTION

The object of the invention is to provide a nosing bar assembly which is of the kind described first hereinbefore and is so designed that illuminated stripes or an illuminated strip marking the nose edges can be seen by a person who is going upstairs as well as by a person who is going downstairs.

This object is accomplished in accordance with the invention in that the surface of said covering means is so arranged that at least some points of said surface can be seen from the space which is disposed above the horizontal plane of the tread surface and which in a view in a downstairs direction is defined by a vertical plane which contains the forward boundary of the tread surface. It is apparent that the object stated hereinbefore can be accomplished by a nosing bar assembly which has no additional illuminating device covered by covering means which lie virtually in the plane of the tread surface of the step provided with the nosing bar assembly and which would be liable to be soiled, worn or damaged by persons going on the stairway. In accordance with the invention, the same covering means and one and the same illuminating device can be seen by a person going upstairs and by a person going downstairs and this can be accomplished by a nosing bar assembly which has a very simple structure.

Advantageous further features and developments of the nosing bar assembly in accordance with the invention are recited in the claims that are dependent on claim 1 and the contents of which is explicitly incorporated in the description although said contents is not repeated here.

Some illustrative embodiments will now be explained more in detail with reference to the drawing, in which

BRIEF SPECIFICATION OF THE DRAWINGS

DESCRIPTION OF PREFERRED EMBODIMENTS

Figure 1:
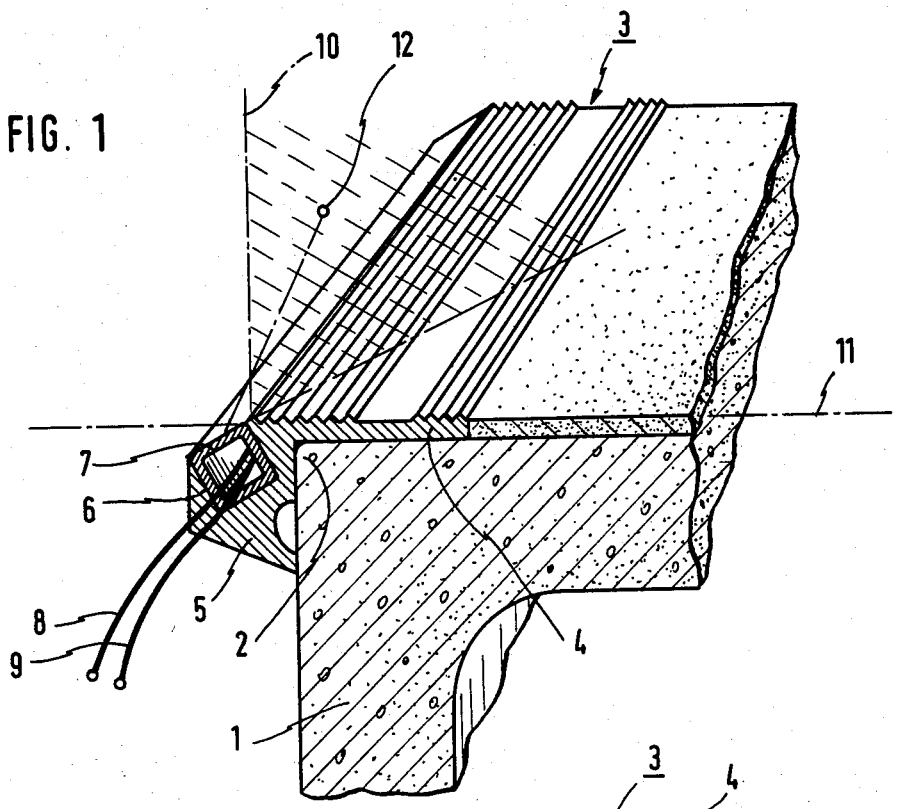
FIG. 1 is a diagrammatic perspective view showing a portion of a step of a stairway and a lightable nosing bar assembly of a preferred embodiment, which nosing bar assembly is secured to said step.

FIG. 1 is a perspective view showing a portion of a step 1 of a stone stairway. A nosing bar assembly is secured, e. g., by means of screws, not shown, to the step 1 near its nose edge 2. The nosing bar assembly comprises a profiled metal rail 3 having a horizontal flange 4, which extends approximately in the plane of the horizontal tread surface of the step 1. A vertical flange 5 of the rail 3 has a noselike edge portion, which bears on the vertical end face of the step 1, and a thicker portion, which is formed below the horizontal tread face with a longitudinally extending groove 6, which is approximately square in cross-section. The side faces of the groove are forwardly inclined from the vertical at an angle of about 30° so that the opening of the groove also faces in said inclined direction. In the description and the claims the forward direction is always downstairs.

The groove 6 of the profiled metal rail 3 contains a slidably inserted tubular bar 7 of transparent plastic. The interior of the profiled tubular bar contains an illuminating device consisting of a plurality of miniature lamps, which are aligned along and connected to lead wires 8 and 9. The lead wires 8 and 9 are connected to a low-voltage source of 12 volts or 24 volts by circuitry not shown in the drawings. A stand-by power supply may be used to feed the illuminating devices of the nosing bar assemblies provided on the steps of a stairway.

The transparent profiled tubular bar 7 is held in the groove 6 by small profiled projections provided at the upper ends of the side faces of the groove. The transparent plastic surface of the transparent profiled tubular bar 7 lies entirely below the horizontal plane of the tread surface so that said transparent plastic surface is substantially protected from abrasion and damage. Because the exposed surface of the transparent profiled tubular bar 7 is inclined, those points of that surface which can be regarded as points of a light source can be seen not only from the front side by a person who is going upstairs but, as is indicated in FIG. 1 by an area which is hatched by dash-dot lines in the paper plane of the drawing, can also be seen from a space which is disposed above the horizontal plane of the tread surface and which in a forward or downstairs direction is limited by a vertical plane which extends thorugh the forward boundary of the tread surface. That vertical plane intersects the paper plane of the drawing in a dash-dot line 10. The horizontal plane of the tread surface intersects the paper plane of the drawing in a dash-dot line 11. From an assumed viewpoint 12, a viewer can see any desired point on the exposed surface of the transparent profiled tubular bar 7 so that when the lighting device has been turned on the nose edge of the step will be marked by an illuminated strip which can also be seen by a person going downstairs. This result will be particularly obtained if the profile of the profiled bar is suitably selected to promote the scattering of the light emitted by the illuminating device.

Figure 2:
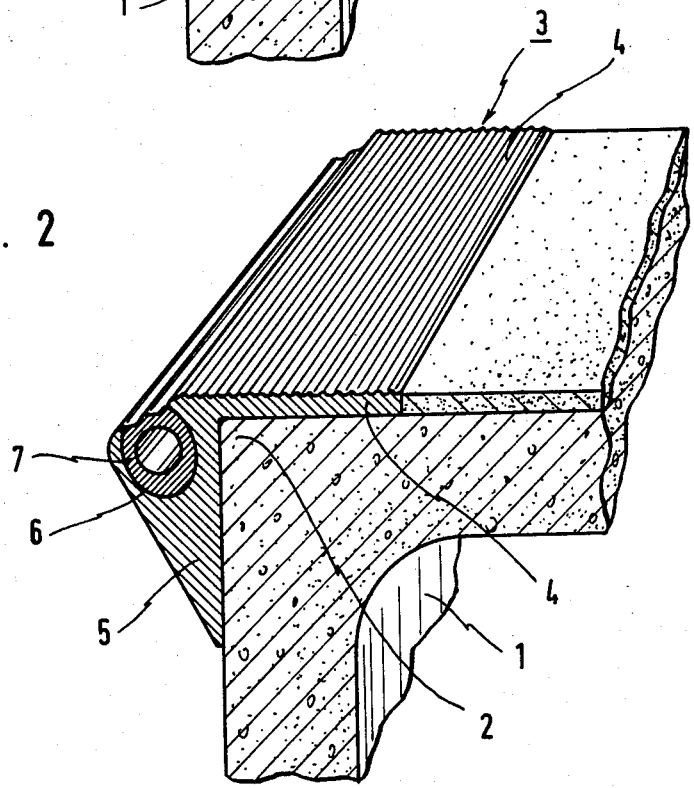
FIG. 2 is a view that is similar to FIG. 1 and shows another embodiment of a nosing bar assembly provided at the nosw edge of a step of a stairway.

The embodiment shown in FIG. 2 differs from the embodiment shown in FIG. 1 in that the transparent profiled tubular bar 7 is substantially oval in cross-section and has been slidably inserted into a conforming groove formed in the vertical flange 5 of the profiled metal rail 3. In the nosing bar assembly shown in FIG. 2, that wall of the transparent profiled tubular bar 7 which is exposed through the opening of the groove in the profiled metal rail constitutes an elongated cylindrical negative lens, by which the light emitted by the illuminating device disposed in the interior of the transparent profiled tubular bar is deflected into the regions which are disposed upstairs and downstairs of said lens. The embodiment shown in FIG. 2 may be modified in that the profiled metal rail 3 adjacent to the opening of the groove and also the transparent profiled tubular bar 7 are so shaped that there is a gradual, curved transition from the metallic surface of the horizontal flange 4 in a downward direction via the surface of the transparent profiled tubular bar to the downwardly extending flange which defines the groove 6 so that there will be no grooves or other recesses in which dirt might accumulate.

Regarding the region containing the point 12 from which the surface of the transparent profiled tubular bar can be seen, the conditions obtained with the embodiment of FIG. 2 are similar to those obtained with the embodiment of FIG. 1.

Figure 3:
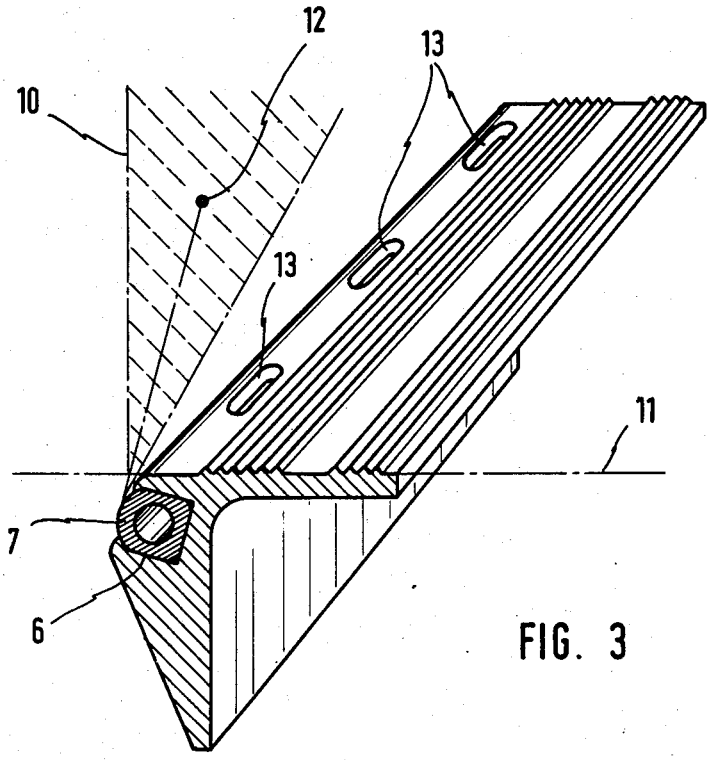
FIG. 3 is a perspective view showing a third embodiment of lightable nosing bar assembly.

The embodiment shown in FIG. 3 differs from the embodiment shown in FIG. 1 in that the opening of the groove 6 faces in a direction which is inclined 60° from the vertical so that said direction has a very large horizontal component. As a result, the region which is indicated by dashdot hatching lines in FIG. 3 and which contains the points 12 from which surface portions of the transparent profiled tubular bar 6 can be seen is relatively narrow and steep. This may be sufficient in many cases, particularly if the stairway is short. The embodiment shown in FIG. 3 affords the advantage that the groove accommodating the profiled tubular bar 7 has such an orientation that the surface of the transparent profiled tubular bar will be more effectively protected from being soiled, damaged and abraded because the relatively delicate surface of the transparent plastic of which the profiled tubular bar 7 is made is almost entirely disposed under that flange of the profiled metal rail which defines the groove 6 at its top.

If the nosing bar assembly is to be used at a stairway which is not likely to be strongly soiled, upwardly facing surface portions of the profiled tubular bar 6 made of transparent plastic may be exposed through additional apertures 13, which are spaced apart along the nose edge of the step and are open toward the tread surface. To a person going downstairs, such apertures 13 will appear as a series of lighted points.

Figure 4:
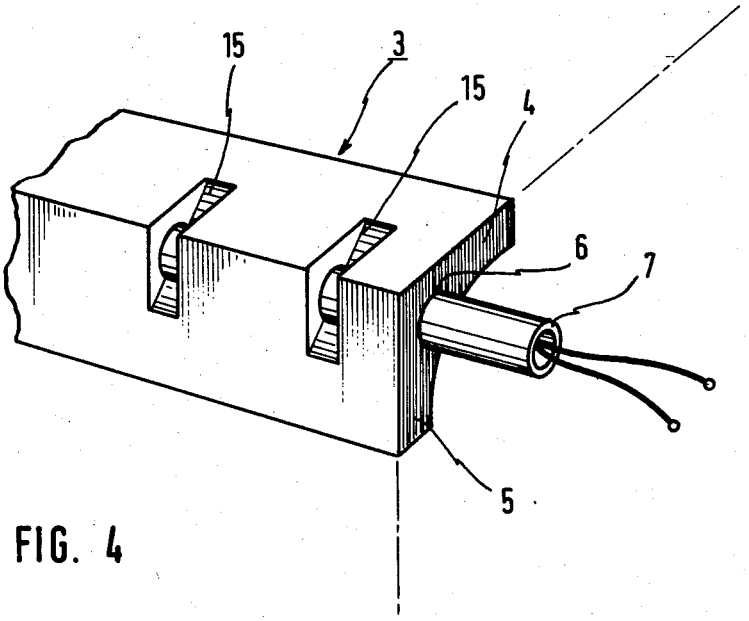
FIG. 4 is a perspective view showing a short portion of a fourth embodiment of a nosing bar assembly of the kind proposed here.

A similar impression will be created for a person going upstairs and for a person going downstairs if a nosing bar assembly as shown in FIG. 4 is provided. In this case the profiled metal rail 3 is substantially an angle section and its corner portion is provided with a bore, which is parallel to the nose edge of the step and contains a slidably inserted transparent profiled tubular bar 6, which has the shape of a circular ring in cross-section. As is indicated in FIG. 4, the profiled metal rail 3 contains inclined incisions, which are spaced apart along the nose edge and extend in planes which are radial with respect to the axis of said bore. Said incisions open into the longitudinally extending bore and expose portions of the surface of the transparent profiled tubular bar 6. Through the inclined incisions, said portions are exposed for a person who is going upstairs and to a person who is going downstairs so that said portions can be seen as light sources when the illuminating device is energized. The inclined incisions 15 in FIG. 4 have such a depth that no dirt will be deposited between the surface of the profiled tubular bar 6 and the bottom of the incisions 15.

The embodiments shown in FIGS. 1 and 2 may comprise modified covering means consisting of a bar of plastic material and in that case the illuminating device may be disposed under said bar in the groove formed in the profile metal rail 3 and may be directly inserted into said groove. The illuminating device which is adapted to be energized and deenergized may be replaced by a fluorescent material, which will provide for an adequate marking of the nose edge of the step in certain cases. The fluorescent material may be contained in the cavity of the profiled tubular bar or in a bar which accupies the groove.

In the description and claims, reference has been made to a profiled metal rail. But such rail might be replaced by a rail of very hard and resistant plastic, which need not be transparent. In this sense the expression "metal rail" is used in the present text in a more general meaning.

What is claimed is:

1. A lightable nosing bar assembly comprising a profiled metal rail (3), which is adapted to be secured to a nose edge (2) of a step (1) of a stairway and is provided in a portion of its cross-section that is disposed below the level of the tread with a longitudinally extending recess (6), which at least in a section of its length is exposed toward the free environment in a direction having a horizontal component, also comprising transparent covering means (7) for covering the exposed portions of the longitudinally extending recess, and an illuminating device (8, 9), which is disposed in the recess behind the covering means and extends throughout the length of the nose edge, characterized in that the surface of said covering means (7) is so arranged that at least some points of said surface can be seen from the space which is disposed above the horizontal plane of the tread surface and which in a view in a downstairs direction is defined by a vertical plane which contains the forward boundary of the tread surface.

2. A nosing bar assembly according to claim 1, characterized in that the profiled metal rail (3) has a wall which is disposed between the longitudinally extending recess (6) and the horizontal plane of the tread surface and said wall is provided with openings (13) or incisions (15), which are spaced apart along the nose edge (2) and through which the covering means (7) are visible from said space.

3. A nosing bar assembly according to claim 2, characterized in that the longitudinally extending opening is formed by a longitudinally extending bore (6) in the corner portion of the angle-shaped profiled metal rail (3), said bore contains a slidably inserted, transparent profiled tubular bar (7), which is circular in cross-section, and said profiled metal rail has inclined incisions (15), which are spaced apart along the profiled metal rail and open into the bore and expose portions of the surface of the transparent profiled tubular bar (7).

4. A nosing bar assembly according to claim 1, characterized in that the covering means comprise a transparent profiled tubular bar, which is approximately rectangular in cross-section and preferably consists of transparent plastic and which has been slidably inserted into a rectangular groove and is held by longitudinally extending profiled ribs on the surfaces of the groove, and the groove conforms to the bar in cross-section and has an opening facing in a direction which has a vertical component.

5. A nosing bar assembly according to claim 1, characterized in that the covering means comprise a profiled tubular bar (7), which is circular or oval in cross-section and which contains in its interior the illuminating device and which has been slidably inserted into a groove, which is formed in the vertical flange (5) of the profiled metal rail (3) and conforms to the bar in cross-section, said groove having an opening which is disposed below the horizontal plane of the tread surface and extends in a plane which is inclined from the horizontal.

6. A nosing bar assembly according to claim 4, characterized in that the surface of the transparent profiled tubular bar (7) is provided in its exposed region with a longitudinally extending rib or curvature.

* * * * *